US011472220B2

(12) United States Patent
Nishitani et al.

(10) Patent No.: US 11,472,220 B2
(45) Date of Patent: Oct. 18, 2022

(54) PEN AND PEN REFILL

(71) Applicant: KURETAKE CO., LTD., Nara (JP)

(72) Inventors: Ichiro Nishitani, Nara (JP); Makiko Morimoto, Nara (JP)

(73) Assignee: KURETAKE CO., LTD., Nara (JP)

( * ) Notice: Subject to any disclaimer, the term of this patent is extended or adjusted under 35 U.S.C. 154(b) by 0 days.

(21) Appl. No.: 17/058,175

(22) PCT Filed: May 28, 2019

(86) PCT No.: PCT/JP2019/021039
§ 371 (c)(1),
(2) Date: Nov. 24, 2020

(87) PCT Pub. No.: WO2019/230702
PCT Pub. Date: Dec. 5, 2019

(65) Prior Publication Data

US 2021/0138824 A1 May 13, 2021

(30) Foreign Application Priority Data

May 28, 2018 (JP) ..... JP2018-101582

(51) Int. Cl.
*B43K 1/00* (2006.01)
*B43K 7/10* (2006.01)
*A45D 34/04* (2006.01)

(52) U.S. Cl.
CPC ..... *B43K 1/006* (2013.01); *B43K 7/10* (2013.01); *A45D 34/042* (2013.01)

(58) Field of Classification Search
CPC ..... B43K 1/00; B43K 1/003; B43K 1/006; B43K 1/02; B43K 1/06; B43K 1/12
See application file for complete search history.

(56) References Cited

U.S. PATENT DOCUMENTS 3,610,766 A 10/1971 Herrnring
3,969,027 A 7/1976 Randar et al.
5,096,322 A * 3/1992 Shiga ..... B43K 1/003 401/199

(Continued)

FOREIGN PATENT DOCUMENTS

CN 2407940 Y 11/2000
GB 2139155 A 11/1984

(Continued)

*Primary Examiner* — David P Angwin
*Assistant Examiner* — Bradley S Oliver
(74) *Attorney, Agent, or Firm* — The Webb Law Firm

(57) ABSTRACT

A pen includes: an ink reservoir configured to store an ink; and a pen tip section including an ink application part configured to apply the ink to an ink application object. The ink application part of the pen tip section includes: a rigid tip made of a rigid material and having a hemispherical outer surface, an inner surface facing toward the ink reservoir, and a penetration part penetrating from the inner surface side to the outer surface side of the rigid tip; and at least one foam body filled in the penetration part at least on the side of the penetration part close to the outer surface side of the rigid tip, and provided with at least one air bubble formed to communicate from the outer surface side of the foam body to the inner surface side of the foam body.

4 Claims, 7 Drawing Sheets

(56) References Cited

U.S. PATENT DOCUMENTS

| | | | | |
|---|---|---|---|---|
| 9,688,092 | B2 | 6/2017 | Niwa | |
| 2006/0263144 | A1* | 11/2006 | Wang | B43K 8/06 401/199 |

FOREIGN PATENT DOCUMENTS

| | | | |
|---|---|---|---|
| JP | S61180769 | U | 11/1986 |
| JP | H288789 | U | 7/1990 |
| JP | 200286974 | A | 3/2002 |
| JP | 2002103878 | A | 4/2002 |
| JP | 2015136808 | A | 7/2015 |

* cited by examiner

PEN AND PEN REFILL

CROSS-REFERENCE TO RELATED APPLICATIONS

This application is the United States national phase of International Application No. PCT/JP2019/021039 filed May 28, 2019, and claims priority to Japanese Patent Application No. 2018-101582 filed May 28, 2018, the disclosures of which are hereby incorporated by reference in their entirety.

BACKGROUND OF THE INVENTION

Field of the Invention

The present invention relates to a pen and a pen refill used as a writing instrument or a makeup instrument.

Description of Related Art

Generally, a pen and a pen refill used as a writing instrument or a makeup instrument include an ink reservoir configured to store an ink, and a pen tip section including an ink application part to slide on an ink application object (hereinafter simply referred to as an application object) in which the ink in the ink reservoir is supplied to the ink application part.

There have been pen tip sections having various configurations. As one of them, a pen tip section having an ink application part made of metal with a hemispherical outer surface has been provided (see Patent Literature 1, for example).

The ink application part of pen tip section of this type has an inner surface facing toward the ink reservoir, an outer surface, and a penetration part penetrating from the inner surface side to the outer surface side of the ink application part. The penetration part is in the form of a slit (gap) or a hole and is configured to guide the ink, which has been supplied by the ink reservoir, from the inner surface side of the ink application part onto the outer surface of the ink application part by the capillary action.

Thereby, according to the pen and the pen refill including the pen tip section of this type, the hemispherical outer surface of the ink application part slides on the application object so that the application object can be applied with the ink guided to the outer surface of the ink application part, i.e., the ink adhered to the hemispherical outer surface of the ink application part. Further, according to the pen and the pen refill of such a type provided with a pen tip section (ink application part) made of metal, abrasion of the pen tip section (ink application part) due to the sliding contact with the application object can be suppressed.

Meanwhile, when the ink is applied to the application object or when the pen tip section slides on the application object, the pen tip section (ink application part) with the aforementioned configuration, which is rigid or inflexible, may cause the surface of the application object to be scratched by an edge which defines the penetration part on the outer surface of the ink application part of the pen tip section.

Therefore, the penetration part is likely to be clogged with shavings of the application object, which may hinder the supply of the ink to the outer surface of the ink application part. Examples of the shavings of the application object include scraps, dust of paper, human skin, sebum, and the like.

Accordingly, the pen and the pen refill with the aforementioned configuration have a problem of making it impossible to stably apply the ink to the application object, although they have an abrasion resistance in application of the ink.

CITATION LIST

Patent Literature

Patent Literature 1: JP 2002-86974 A

SUMMARY OF THE INVENTION

Technical Problem

Therefore, it is an object of the present invention to provide a pen and a pen refill capable of stably applying ink to an application object while suppressing the abrasion of an ink application part.

Solution to Problem

A pen according to the present invention includes:

an ink reservoir configured to store an ink; and a pen tip section including an ink application part configured to apply the ink to an ink application object, the ink being supplied from the ink reservoir to the pen tip section, the ink application part of the pen tip section including:

a rigid tip made of a rigid material and having a hemispherical outer surface, an inner surface facing toward the ink reservoir, and a penetration part penetrating from the inner surface side to the outer surface side of the rigid tip; and at least one foam body filled in the penetration part at least on the side of the penetration part close to the outer surface of the rigid tip, and provided with at least one air bubble formed to communicate from the outer surface side of the foam body to the inner surface side of the foam body.

According to one form of the present invention, the penetration part may have slits passing through an apex of the outer surface of the rigid tip, and the slits may be arranged around the apex of the outer surface of the rigid tip in a radial manner.

In this case, the slits may have different widths from each other.

According to another form of the present invention, it is preferable that the at least one foam body be elastically deformable.

A pen refill according to the present invention includes:

an ink reservoir configured to store an ink and be housed in a body shaft part that constitutes an outer shell of a pen; and a pen tip section including an ink application part exposed from the body shaft part and configured to apply the ink to an ink application object, the ink being supplied from the ink reservoir to the pen tip section, the ink application part of the pen tip section including:

a rigid tip made of a rigid material and having a hemispherical outer surface, an inner surface facing toward the ink reservoir, and a penetration part penetrating from the inner surface side to the outer surface side of the rigid tip; and at least one foam body filled in the penetration part at least on the side of the penetration part close to the outer surface of the rigid tip, and provided with at least one air bubble formed to communicate from the outer surface side of the foam body to the inner surface side of the foam body.

According to one form of the present invention, the penetration part may have slits passing through an apex of the outer surface of the rigid tip, and the slits may be arranged around the apex of the outer surface of the rigid tip in a radial manner.

In this case, the slits may have different widths from each other.

According to another form of the invention, it is preferable that the at least one foam body be elastically deformable.

DESCRIPTION OF THE INVENTION

Hereinafter, one embodiment of the present invention will be described with reference to the accompanying drawings. The present invention is used as a writing instrument or a makeup instrument. Herein, the description will be made by taking, for example, a writing instrument, an ink application object of which is a sheet paper, a notebook, or the like.

Figure 1:
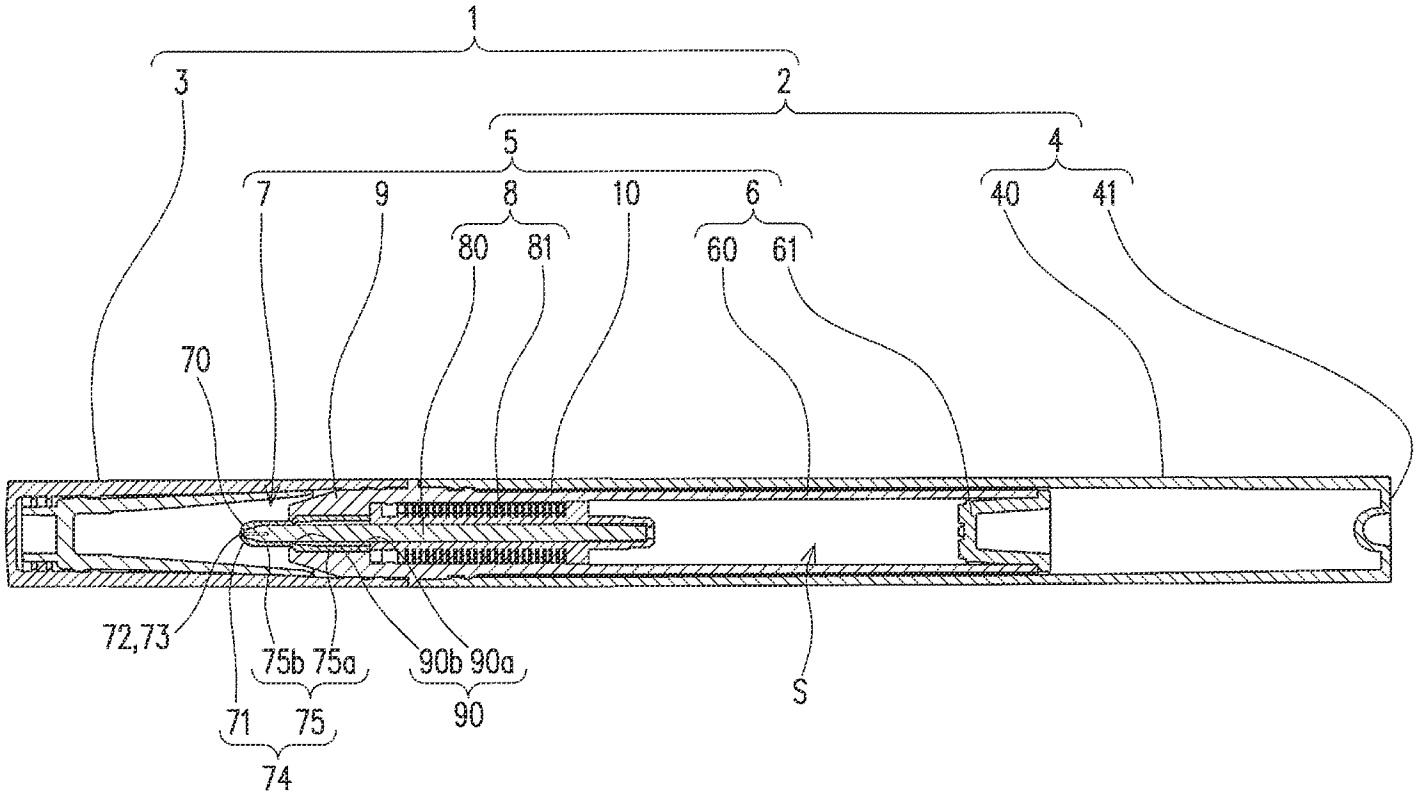
FIG. 1 is a cross-sectional view of a pen according to an embodiment of the present invention.
Figure 2:
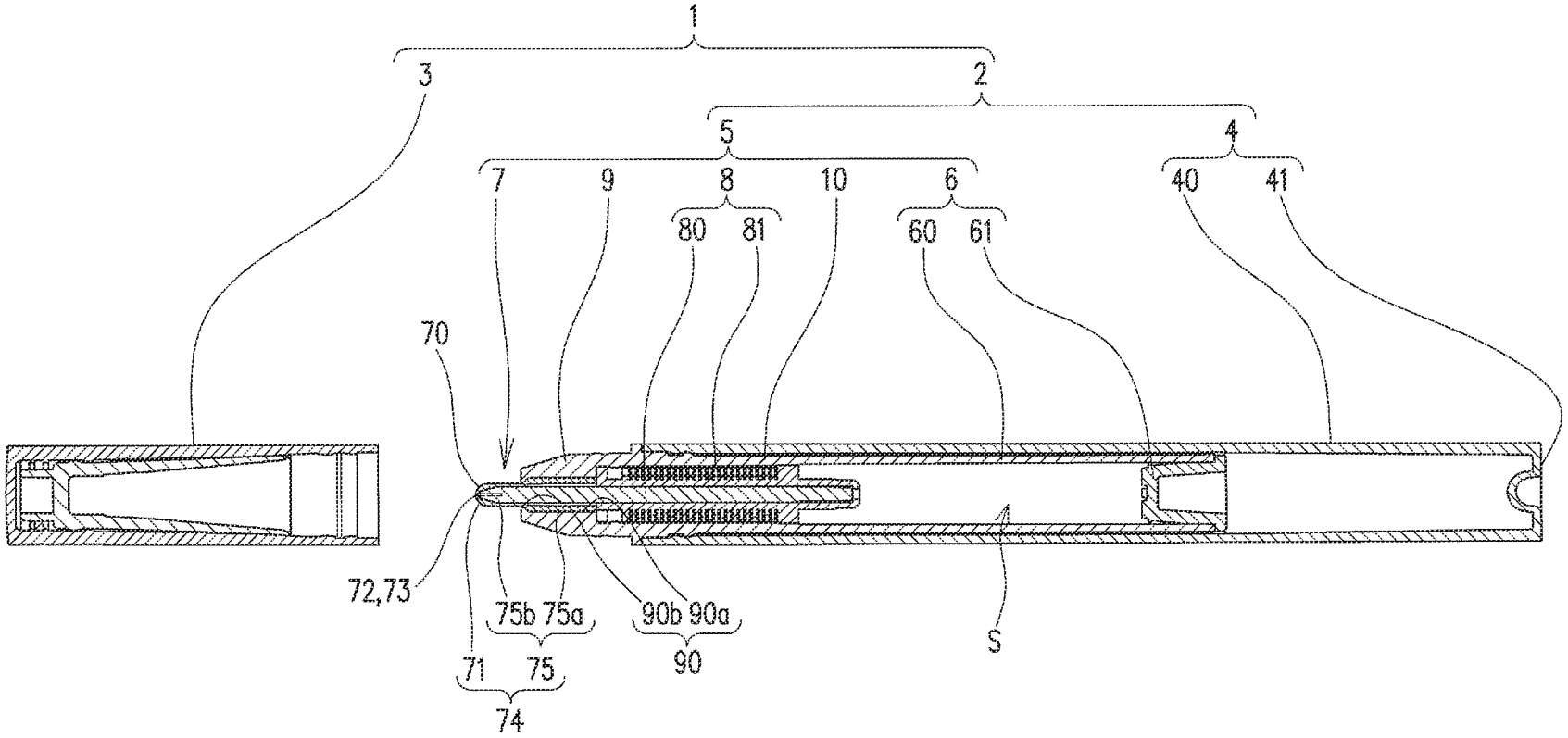
FIG. 2 is a cross-sectional view of the pen according to the embodiment in a state where a cap is removed from a pen body.

As shown in FIG. 1 and FIG. 2, the pen 1 according to this embodiment includes a pen body 2 that has an ink application part 70 for applying ink to an ink application object (hereinafter, simply referred to as a application object), and a cap 3 that covers at least the ink application part 70 of the pen body 2.

The pen body 2 includes an outer housing 4 that constitutes an outer shell, and a pen refill 5 (hereinafter, simply referred to as a refill) that is mounted inside the outer housing 4.

The outer housing 4 includes a cylindrical body shaft part 40 having a first end and a second end on the opposite side of the first end, and a tail 41 that closes the first end of the body shaft part 40.

The refill 5 includes an ink reservoir 6 configured to store an ink and to be housed in the body shaft part 40 that constitutes an outer shell of the pen 1; and a pen tip section 7 including an ink application part 70 exposed from the body shaft part 40, the ink being supplied from the ink reservoir 6 to the pen tip section 7.

A more specific description will be given. The refill 5 according to this embodiment includes the ink reservoir 6, the pen tip section 7, an ink guide part 8 that guides the ink in the ink reservoir 6 toward the pen tip section 7, and a holder part 9 that holds the pen tip section 7 while allowing the ink application part 70 of the pen tip section 7 to be exposed therefrom. In this embodiment, the refill 5 further includes a connection part 10 for connecting the ink reservoir 6 with the holder part 9.

The ink reservoir 6 is formed in a bottomed cylindrical shape, for example, in a bottomed cylindrical shape having a circular cross section. For example, the ink reservoir 6 has a peripheral wall 60 that defines an internal space S for storing the ink. More specifically, the ink reservoir 6 of this embodiment includes a cylindrical peripheral wall 60 having a first end and a second end on the opposite side of the first end, and a closure part 61 that closes the first end of the peripheral wall 60. With this configuration, the ink reservoir 6 has the internal space S closed with the peripheral wall 60 and the closure part 61. In this embodiment, the internal space S of the ink reservoir 6 is filled with a liquid ink.

Figure 3:
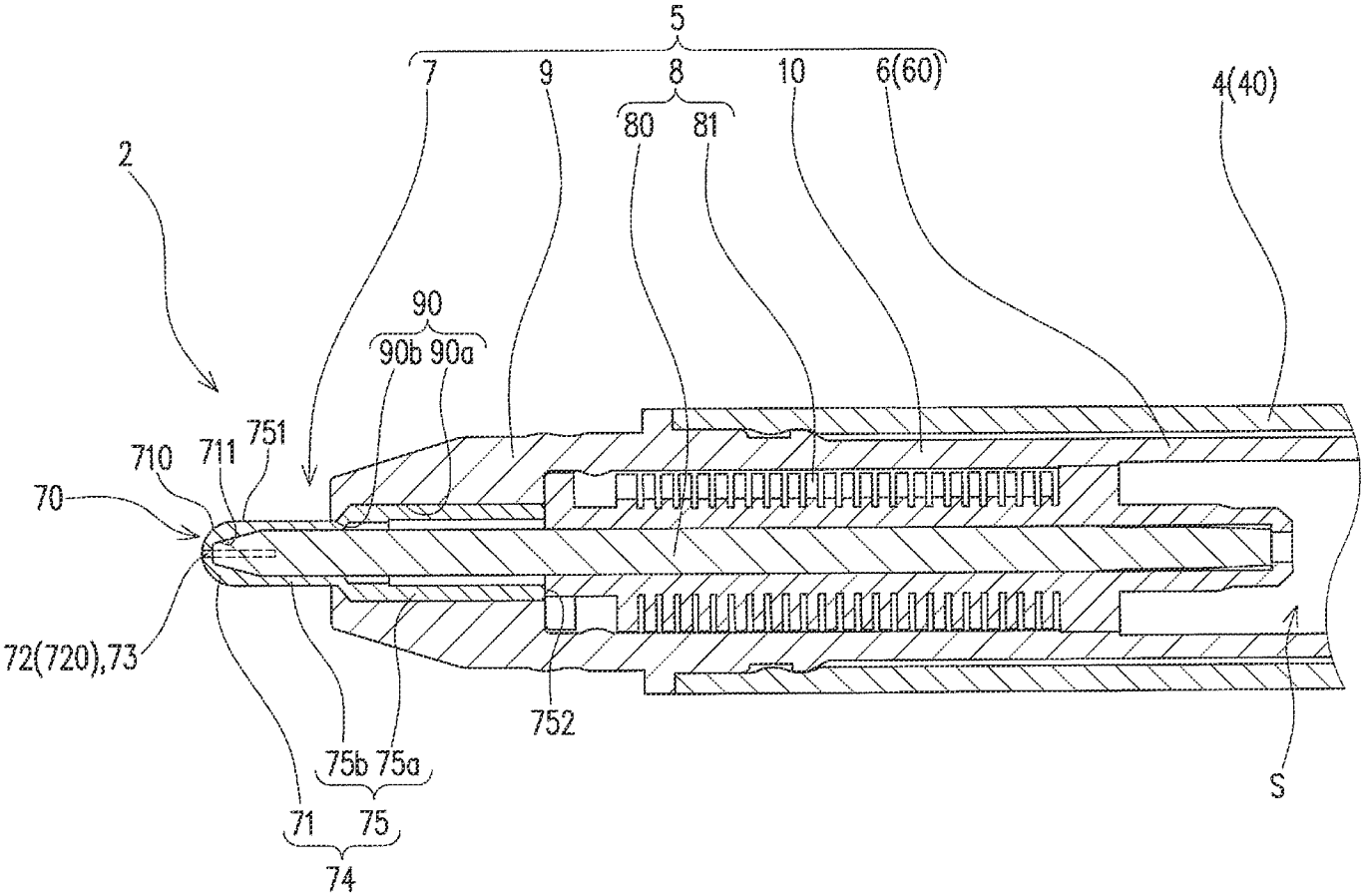
FIG. 3 is a partial enlarged cross-sectional view of the pen (pen body) according to the embodiment.

As shown in FIG. 3, the ink application part 70 of the pen tip section 7 includes a rigid tip 71 made of a rigid material and having a hemispherical outer surface 710, an inner surface 711 facing toward the ink reservoir 6, a penetration part 72 penetrating from the inner surface 711 side to the outer surface 710 side, and at least one foam body 73 filled in the penetration part 72 at least on the side of the penetration part 72 close to the outer surface 710 of the rigid tip 71.

A more specific description will be given. The pen tip section 7 includes a pen tip member 74 having a rigid tip 71, and at least one foam body 73.

The pen tip member 74 is molded with a rigid material such as metal and ceramic. The pen tip member 74 according to this embodiment is made of metal.

Figure 4:
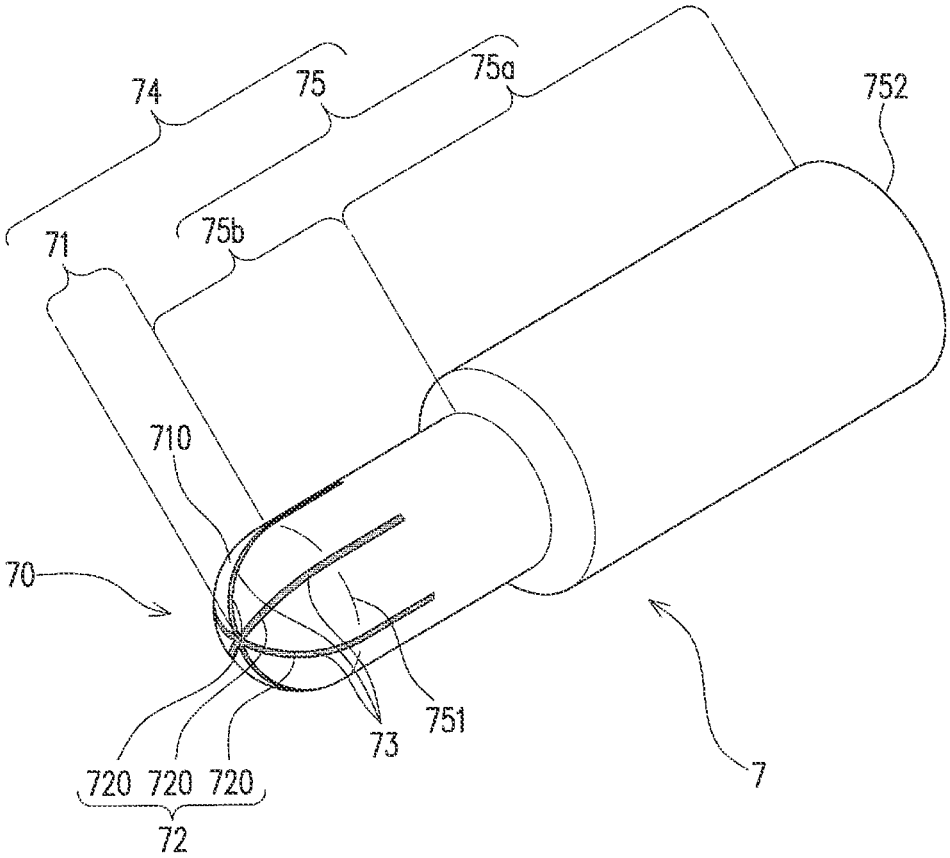
FIG. 4 is a perspective view of a pen tip section according to the embodiment.

As shown in FIG. 4, the pen tip member 74 includes a cylindrical body 75 having a first end 751 and a second end 752 on the opposite side of the first end 751, and the rigid tip 71 connected to the first end 751 of the cylindrical body 75.

The cylindrical body 75 includes a large diameter cylindrical part **75*a* and a small diameter cylindrical part 75*b* having a smaller diameter than the large diameter cylindrical part 75*a*. The large diameter cylindrical part 75*a* and the small diameter cylindrical part 75*b* are coaxially arranged, and a first end of the large diameter cylindrical part 75*a* is connected to a first end of the small diameter cylindrical part 75*b*. That is, the large diameter cylindrical part 75*a* and the small diameter cylindrical part 75*b* are connected to each other with a stepped portion (not numbered) at the boundary therebetween. Thereby, a second end of the small diameter cylindrical part 75*b* constitutes the first end 751 of the cylindrical body 75, and a second end of the large diameter cylindrical part 75*a* constitutes the second end 752 of the cylindrical body 75. In this embodiment, the small diameter cylindrical part 75*b* has such an inner diameter as to allow a relay core 80 to be described later of the ink guide part 8 to be inserted into the small diameter cylindrical part 75*b***.

In this embodiment, the inner surface 711 of the rigid tip 71 has a non-similar shape to the outer surface 710 of the rigid tip 71 as shown in FIG. 3. Specifically, whereas the outer surface 710 of the rigid tip 71 has a hemispherical shape protruding outward, the inner surface 711 of the rigid tip 71 is a tapered surface being outwardly tapered. The shape of the outer surface 710 of the rigid tip 71 is not particularly limited. The inner surface 711 of the rigid tip 71 is, for example, a tapered surface being tapered toward the apex of the rigid tip 71. In this embodiment, an area of the inner surface of the cylindrical body 75 near the rigid tip 71 is formed with a tapered surface. For example, a part of the inner surface of the small diameter cylindrical part **75*b* of the inner surface of the cylindrical body 75 is formed with a tapered surface. Further, for example, the inner surface (tapered surface) of the rigid tip 71 is continuous with the tapered surface which is a part of the inner surface of the cylindrical body 75 near the rigid tip 71. That is, the inner surface 711 of the rigid tip 71 and a part of the inner surface of the cylindrical body 75 (small diameter cylindrical part 75***b*), which part is located near the inner surface 711, share the common tapered surface. In other words, the inner surface 711 of the rigid tip 71 and a part of the inner surface of the cylindrical body 75 (small diameter cylindrical part 75*b*) form tapered surfaces of the same taper angle.

The rigid tip 71 has an outer circumferential end having an annular ring shape around the inner surface 711. The outer circumferential end of the rigid tip 71 is liquid-tightly connected throughout the entire circumference with the first end 751 of the cylindrical body 75. The first end 751 of the cylindrical body 75 is, for example, the second end of the small diameter cylindrical part 75*b*.

That is, the rigid tip 71 is arranged so that a straight imaginary line passing through the apex of the outer surface 710 of the rigid tip 71 and the center of the annular ring-shaped outer circumferential end coincides with the center line of the cylindrical body 75 (cylindrical axis). The center of the outer circumferential end is, for example, the center of the outer surface 710, specifically, the center of the curvature of the circumferential periphery of the outer surface 710.

The rigid tip 71 is provided with a penetration part 72 penetrating between the inside and the outside of the rigid tip 71 (penetrating the inside and outside of the rigid tip 71). In this embodiment, as shown in FIG. 4, the penetration part 72 has a plurality of slits 720 passing through the apex of the rigid tip 71. The plurality of slits 720 are arranged around the apex of the rigid tip 71 in a radial manner. Specifically, the plurality of slits 720 (e.g., 6 slits) are arranged at equal intervals around the straight imaginary line passing through the apex of the rigid tip 71 and the center of the curvature of the circumferential periphery of the outer surface 710 of the rigid tip 71. In this embodiment, the plurality of slits 720 are set to have the same width or substantially the same width.

In this embodiment, each of the plurality of slits 720 penetrates between the inside and the outside of the rigid tip 71. In other words, each of the plurality of slits 720 allows for penetration between the inner surface 711 side and the outer surface 710 side of the rigid tip 71. Each of the plurality of slits 720 extends beyond the rigid tip 71 and reaches a middle point of the small diameter cylindrical part 75*b*.

In this embodiment, the pen tip member 74 is produced by processing a metal rod material. Specifically, the pen tip member 74 is produced by machining one end of the metal rod material into a hemispherical shape, then providing cutouts (slits) in the hemispherical portion (portion to be served as the rigid tip 71), and then forming a hole in the rod material, the hole extending from the second end (end surface) toward the first end. In this embodiment, the metal rod material is a rod with two stepped portions including a small diameter portion and a large diameter portion, in which one end of the rod material is an end of the small diameter portion. In this embodiment, the pen tip member 74 is produced by cutting inwardly from the second end toward the first end of the metal rod material. In a production process of the pen tip member 74, a step of forming the cutouts in the hemispherical portion (portion to be served as the rigid tip 71) may be performed before a step of forming the hole in the rod material, for example, before a step of cutting inwardly from the second end toward the first end of the metal rod material. Further, in the production process of the pen tip member 74, a step of forming the hole in the rod material, for example, a step of cutting inwardly from the second end toward the first end of the metal rod material, may be performed before a step of forming the cutouts in the hemispherical portion (portion to be served as the rigid tip 71).

Figure 5:
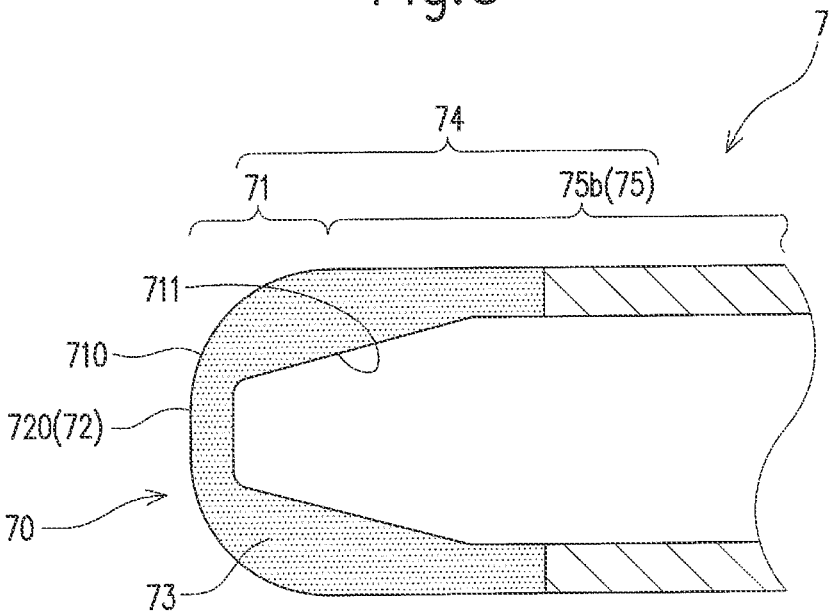
FIG. 5 is a partial enlarged cross-sectional view of the pen tip section according to the embodiment.
Figure 6:
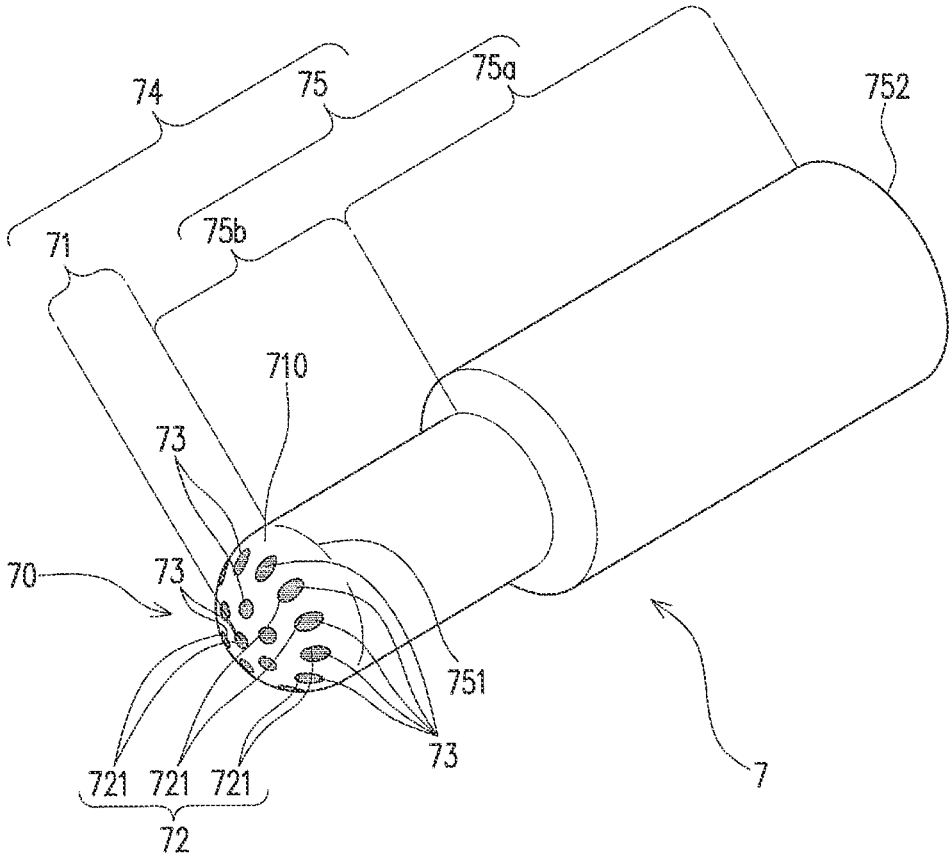
FIG. 6 is a perspective view of a pen tip section according to another embodiment of the present invention.

In this embodiment, each of the at least one foam body 73 is entirely filled in each corresponding penetration part 72 as shown in FIG. 5. Each of the at least one foam body 73 is filled from the edge of each corresponding penetration part 72 located on the side close to the outer surface 710 of the rigid tip 71 to the edge of the penetration part 72 located on the side close to the inner surface 711 of the rigid tip 71 as shown in FIG. 6. In this embodiment, a plurality of foam bodies 73 (e.g., 6 foam bodies) are provided. Specifically, each of the foam bodies 73 is arranged in each corresponding one of the slits 720. Further, each of the slits 720 is substantially entirely filled with the foam bodies 73. Specifically, each of the slits 720 is filled with each of the foam bodies 73 from a position of the slit 720 near the outer surface 710 of the rigid tip 71 to a position of the slit 720 near the inner surface 711 of the rigid tip 71.

In this embodiment, each of the foam bodies 73 is elastically deformable. For example, the foam body 73 is molded with a resin material. The foam body 73 of this embodiment is molded with a urethane resin. An air bubble of the foam body 73 is formed by removing an additive mixed in a resin material after the molding of the resin material (e.g., after the resin material is filled in the penetration part 72 or after the resin material is molded to conform to the shape of the penetration part 72). In this embodiment, an air bubble of the foam body 73 is formed by, for example, removing sodium chloride as an additive mixed in a urethane resin as the resin material (that is, by subjecting the urethane resin to desalination treatment), after the resin material is filled in the penetration part 75 or after the resin material is molded to conform to the shape of the penetration part 72.

In this embodiment, each of the foam bodies 73 has plural air bubbles. The air bubbles communicate with each other. Each of the air bubbles is open to the outer surface (e.g., outer surface 710 of the rigid tip 71). Also, each of the air bubbles provides communication from the outer surface 710 side of the foam body 73 to the inner surface 711 side of the foam body 73. Specifically, each of the air bubbles extends continuously from the position near the outer surface 710 of the rigid tip 71 to the position near the inner surface 711 of the rigid tip 71.

Each of the air bubbles is, for example, randomly arranged in the foam body 73. The air bubbles may extend from the inside to the outside of the rigid tip 71 in a substantially straight line, a substantially curved line, a meandering line, or the like. The air bubbles may also extend to form a tree shape from the inside to the outside of the rigid tip 71.

Each of the foam bodies 73 may have one air bubble. In this case, the one bubble may be open to the outer surface (e.g., the outer surface 710 of the rigid tip 71). The one bubble may communicate from the outer surface 710 side of the foam body 73 to the inner surface 711 side of the foam body 73.

Returning to FIG. 3, the ink guide part 8 according to this embodiment includes the relay core 80 that allows an ink to be supplied from the ink reservoir 6 to the pen tip section 7, and a collector 81 that is configured to regulate the ink supply amount of the relay core 80.

The relay core 80 is formed in a rod shape and has a first end connected to the ink reservoir 6 and a second end opposite to the first end. Specifically, the relay core 80 has liquid absorbency, and is molded in a rod shape having a length extending between the ink reservoir 6 (internal space 5) and the pen tip section 7.

The second end of the relay core 80 is formed to conform to the shape of the inner surface 711 of the rigid tip 71. In this embodiment, the second end of the relay core 80 is formed in a tapered shape when the inner surface 711 of the rigid tip 71 is formed with a tapered surface. That is, the second end of the relay core 80 is formed to be able to tightly contact the inner surface 711 of the rigid tip 71. In this embodiment, the inner surface 711 (tapered surface) of the rigid tip 71 is continuous with the adjacent tapered surface that is a part of the inner surface of the cylindrical body 75. With this configuration, the second end of the relay core 80 is formed in a tapered shape in an area corresponding to the tapered surface that is the inner surface 711 of the rigid tip 71 and the tapered surface (the common tapered surface) that is a part of the inner surface of the cylindrical body 75. Thereby, the second end of the relay core 80 can tightly contact the inner surface 711 of the rigid tip 71 and a part of the inner surface of the cylindrical body 75.

The relay core 80 is produced by molding a material (a foamable resin or a fibrous material) having excellent liquid absorbency into a rod shape. An ink circulation path (not shown) allowing the ink to circulate in the relay core 80 is formed continuously from the first end to the second end of the relay core 80 on the outer surface of the relay core 80 or inside the relay core 80. The ink circulation path is composed of a fine groove or fine continuous hole (air bubble).

The relay core 80 extends through the collector 81. The relay core 80 has at least a first end surface on the first end side exposed to the internal space S of the ink reservoir 6, and the second end side located inside the pen tip section 7 (pen tip member 74).

The second end of the relay core 80 serves as a supply position of an ink to the pen tip section 7. The relay core 80 according to this embodiment is inserted into the cylindrical body 75 of the pen tip member 74 so as to have the second end of the relay core 80 reaching the rigid tip 71 of the pen tip member 74. Thereby, the relay core 80 can supply the ink into the rigid tip 71 of the pen tip member 74. In this embodiment, the second end of the relay core 80 is fitted into the rigid tip 71 of the pen tip member 74. In this embodiment, the outer surface of the second end of the relay core 80 tightly contacts the inner surface 711 of the rigid tip 71. Thereby, the relay core 80 in this embodiment is configured to allow the ink to pass through the inside of the rigid tip 71 and to be supplied to the slits 720 (foam body 73).

The collector 81 is a so-called vane-shaped regulator employed in a direct liquid type pen such as a fountain pen. The collector 81 is arranged between the ink reservoir 6 and the pen tip section 7 to suppress the excessive ink supply to the relay core 80 inserted through the collector 81.

The holder part 9 has a through hole 90 through which the pen tip section 7 is inserted, that is, through which the pen tip section 7 is inserted to have a tip side (a side close to the ink application part 70) extending to the outside.

The holder part 9 is formed in a cylindrical shape. In this embodiment, the holder part 9 is arranged coaxially with the ink reservoir 6. The holder part 9 is molded separately from or integrally with the ink reservoir 6, and in this embodiment, the holder part 9 is molded integrally with the ink reservoir 6. Specifically, in the refill 5 according to this embodiment, the holder part 9 is formed to be continuous with the ink reservoir 6 via the connection part 10.

The through hole 90 of the holder part 9 includes a first hole 90*a* that is set to allow the large diameter cylindrical part 75*a* of the cylindrical body 75 of the pen tip member 74 to be inserted thereinto, and a second hole 90*b* that is arranged coaxially and continuously with the first hole 90*a* and allows the small diameter cylindrical part 75*b* of the cylindrical body 75 of the pen tip member 74 to be inserted thereinto. A central axis direction of the through hole 90 is a direction along the cylindrical axis direction of the cylindrical body 75.

In this embodiment, since the large diameter cylindrical part 75*a* has a larger diameter than the small diameter cylindrical part 75*b*, the first hole 90*a* is set to have a larger diameter than the second hole 90*b*. The length of the first hole 90*a* of the through hole 90 in the central axis direction is set to be the same or substantially the same as the length of the large diameter cylindrical part 75*a* of the cylindrical body 75 in the cylindrical axial direction. Contrary to this, the length of the second hole 90*b* of the through hole 90 in the central axis direction is set to be smaller than the length of the small diameter cylindrical part 75*b* of the cylindrical body 75 in the cylindrical axial direction. Thereby, the tip (ink application part 70) of the pen tip section 7 protrudes from the holder part 9 in a state where the pen tip section 7 (pen tip member 74) is inserted into the through hole 90.

The connection part 10 is formed in a cylindrical shape so as to allow the ink guide part 8 to be fittable thereinto. The connection part 10 is arranged coaxially with the holder 9 and the ink reservoir 6. A first end of the connection part 10 is connected to the holder part 9, and a second end of the connection part 10 is connected to the peripheral wall 60 of the ink reservoir 6. The connection part 10 is molded separately from or integrally with the peripheral wall 60 and the holder part 9. In this embodiment, the connection part 10 is molded integrally with the peripheral wall 60 and the holder part 9. The ink guide part 8 (i.e., the collector 81 with the relay core 80 inserted therethrough) is fitted into the connection part 10.

The configuration of the refill 5 is as described above. The refill 5 is fitted into the outer housing 4 (i.e., the body shaft part 40). In the pen body 2 of this state, the holder part 9 and a part of the connection part 10, as well as the ink application part 70 of the pen tip section 7, are exposed to the outside. Thereby, in this embodiment, a part of the connection part 10 and the holder part 9 of the pen body 2 (refill 5) exposed to the outside constitute a grip part for a user.

The pen 1 (refill 5) according to this embodiment is as described above. Next, the description will be given for the function.

In the pen 1 (refill 5) with the aforementioned configuration, the ink in the ink reservoir 6 is guided toward the pen tip section 7 by the ink guide part 8. More specifically, the relay core 80 of the ink guide part 8 guides the ink, a supply amount of which is appropriately regulated by the collector 81, to the inside of the pen tip section 7.

Then, the ink guided to the inside of the pen tip section 7 (the ink passing through the inside of the pen tip member 74) is guided to the outer surface 710 of the rigid tip 71 through the air bubbles of the foam body 73. Thereby, when the pen tip section 7 (ink application part 70) is made to contact (or slide on) the application object, the ink is applied to the application object. At this time, the application object may be scratched by the edge defining the penetration part 72 on the outer surface 710 of the rigid tip 71 since the user moves the pen tip section 7 (ink application part 70) on the surface of the application object. However, the foam body 73 filled in the penetration part 72 of the ink application part 70 of the pen 1 (refill 5) according to this embodiment prevents shavings (paper dust or the like) from entering the penetration part 72 and being accumulated therein. Further, the ink is stably supplied through the air bubbles of the foam body 73 in the pen 1 (refill 5) according to this embodiment. Thereby, the pen 1 (refill 5) according to this embodiment can stably apply the ink.

As described above, the pen 1 according to this embodiment includes: the ink reservoir 6 configured to store the ink; and the pen tip section 7 including the ink application part 70 configured to apply the ink to the application object, the ink being supplied from the ink reservoir 6 to the pen tip section 7, the ink application part 70 of the pen tip section 7 including: the rigid tip 71 made of a rigid material and having the hemispherical outer surface 710, the inner surface 711 facing toward the ink reservoir 6, and the penetration part 72 penetrating from an inner surface 711 side to the outer surface 710 side; and the foam body 73 filled in the penetration part 72 at least on a side of the penetration part close to the outer surface 710 of the rigid tip 71.

That is, the refill 5 in this embodiment includes: the ink reservoir 6 configured to store the ink and be housed in the body shaft part 40 that constitutes an outer shell of the pen 1; and the pen tip section 7 including the ink application part 70 exposed from the body shaft part 40 and configured to apply the ink to the application object, the ink being supplied from the ink reservoir to the pen tip section, the ink application part 70 of the pen tip section 7 including: the rigid tip 71 made of a rigid material and having the hemispherical outer surface 710, the inner surface 711 facing toward the ink reservoir 6, and the penetration part 72 penetrating from the inner surface 711 side to the outer surface 710 side; and the foam body 73 filled in the penetration part 72 at least on a side of the penetration part 72 close to the outer surface 710 of the rigid tip 71.

According to the aforementioned configuration, since the rigid tip 71 constituting the ink application part 70 is made of a rigid material, abrasion due to the sliding of the rigid tip 71 on the application object can be suppressed. Shavings of the application object may be generated from the application object as before due to the edge formed on the outer surface 710 of the rigid tip 71 for defining the penetration part 72 that penetrates between the inner surface 711 side and the outer surface 710 side of the rigid tip 71.

However, according to the pen 1 with the aforementioned configuration, the foam body 73 is filled in the penetration part 72 at least on the side of the penetration part 72 close to the outer surface 710 of the rigid tip 71, and therefore the shavings of the application object are not allowed to enter (accumulate in) the penetration part 72. Since the foam body 73 has air bubbles open to the outer surface, the air bubbles allow the ink application part 70 (rigid tip 71) to communicate from the inside to the outside, that is, the air bubbles provide communication between the inside and the outside of the ink application part 70 (rigid tip 71).

Accordingly, the ink is stably supplied to the outer surface 710 of the rigid tip 71 through the air bubbles of the foam body 73. Thereby, the ink can be stably applied to the application object by making the outer surface 710 of the pen tip section 7 (rigid tip 71) slide on (contact) the application object.

Therefore, the pen 1 (refill 5) according to this embodiment can exhibit an excellent effect of being able to stably apply the ink to the application object while suppressing the abrasion of the ink application part 70.

In this embodiment, the penetration part 72 has slits 720 passing through the apex of the outer surface 710 of the rigid tip 71, and the slits 720 are arranged around the apex of the outer surface 710 of the rigid tip 71 in a radial manner. Thus, the slits 720 are arranged at positions around the apex of the outer surface 710 of the rigid tip 71. Accordingly, the frequency at which the penetration part 72 (foam body 73) of the rigid tip 71 (ink application part 70) faces the application object increases. Thereby, the ink can be stably applied to the application object even if the user uses the pen 1 in any inclination (posture).

In this embodiment, the foam body 73 is elastically deformable, so that the foam body 73 exposed from the penetration part 72 is deformed when it contacts the application object. Thereby, it is possible to suppress the foam body 73 from scratching the application object (from damaging the application object).

The present invention is not limited to the aforementioned embodiment, and modifications can be appropriately made without departing from the gist of the present invention.

The description of the aforementioned embodiment was given for the pen 1 as a writing instrument for writing, but the present invention is not limited thereto. For example, the pen may of course be employed as a pen used as a makeup instrument for makeup. The pen refill may of course be employed as a refill for a pen that is used as a makeup instrument for makeup.

Although not specifically mentioned in the aforementioned embodiment, the refill 5 may be fixed to the outer housing 4 (body shaft part 40) or may be detachably (replaceably) attached to the outer housing 4 (body shaft part 40).

Further, the present invention is not limited to the pen 1 in which the refill 5 is attached to the outer housing 4 (body shaft part 40), and may be, for example, the pen 1 in which the outer housing 4 (body shaft part 40) forms the ink reservoir 6, and the ink guide part 8, the holder part 9, and the pen tip section 7 are attached to the outer housing 4 (body shaft part 40). That is, the refill 5 itself may constitute a pen.

In the aforementioned embodiment, the liquid ink is stored as usual in the ink reservoir 6 formed in a bottomed cylindrical shape, and the ink guide part 8 is configured to include the collector 81 for regulation of the ink supply amount from the ink reservoir 6 to the pen tip section 7, but the present invention is not limited thereto. For example, it may be configured such that the ink guide part 8 includes only the relay core 80, and the ink of the ink reservoir 6 is supplied to the pen tip section 7 by the relay core 80.

Further, the ink reservoir 6 may be an ink occlusion material filled in the entire internal space S with an ink occluded therein, or the ink reservoir 6 may be configured such that a liquid ink is filled in a given area of the internal space S and an ink occlusion material having liquid absorbency filled in the remaining area of the internal space S with an ink occluded therein.

In the aforementioned embodiment, the penetration part 72 has the slits 720, but is not limited thereto. For example, as shown in FIG. 6, instead of the slits 720, the penetration part 72 may have holes 721 penetrating between the inside and the outside of the rigid tip 71 (from the inside to the outside of the rigid tip 71). Also in this case, the same function and effect as in the aforementioned embodiment can be exhibited by filling each of the holes 721 with the foam body 73.

When the penetration part 72 has the holes 721 as above, the holes 721 may have the same shape and the same size, but may respectively have different shapes or different sizes. Further, the holes 721 may be circular holes, or holes of various shapes such as long holes and square holes. In the case where the holes 721 are long holes, the holes 721 are arranged to each have a longitudinal length in a direction, in which the center line of the cylindrical body 75 extends, and arranged at intervals around the center line (cylindrical axis) of the cylindrical body 75, so that the holes 721 are arranged in a similar manner to the slits 720 of the aforementioned embodiment.

In the aforementioned embodiment, the pen tip member 74 is produced by processing a metal rod material, but is not limited thereto. For example, the pen tip member 74 (rigid tip 71) may be produced by providing an end of a metal cylindrical member with cutouts (slits) extending in the same direction as the direction in which the center line of the metal cylindrical member extends, and then bending (or drawing radially inwardly) the end of the metal cylindrical member. Further, in the case where the pen tip member 74 is made of an inorganic material such as ceramic, the pen tip member 74 may be produced by molding a powdery inorganic material into a shape corresponding to a finished product and then firing the molded inorganic material.

Figure 7:
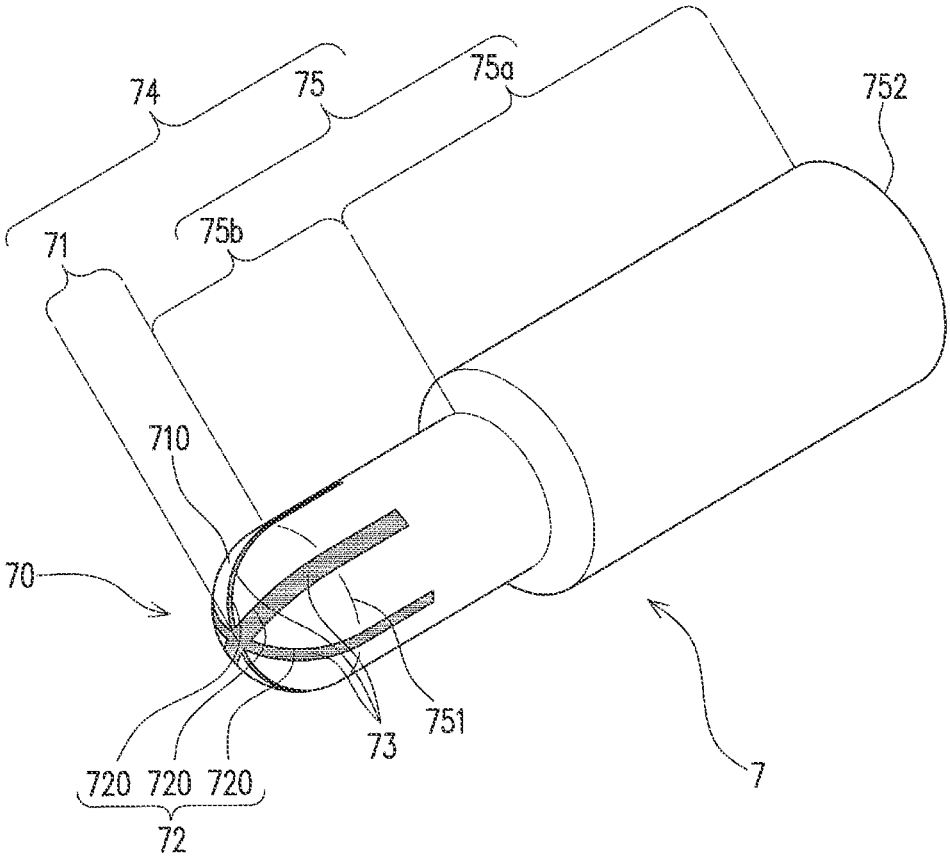
FIG. 7 is a perspective view of a pen tip section according to still another embodiment of the present invention.

In the aforementioned embodiment, the slits 720 of the penetration part 72 are set to have the same width or substantially the same width as each other, but are not limited thereto. For example, as shown in FIG. 7, the slits 720 of the penetration part 72 may have different widths from each other. With this, an ink ejection amount (ink adhesion amount to the application object) can be changed by changing the posture or position of the pen 1 at the time of application of the ink to change the slit(s) 720 facing the application object with the other one(s). Thereby, the width of a line can be varied.

In the aforementioned embodiment, the slits 720 of the penetration part 72 extend beyond the rigid tip 71 reach the middle point of the cylindrical body 75 (small diameter cylindrical part 75*b*), but are not limited thereto. For example, the slits 720 of the penetration part 72 may be formed within an area of the rigid tip 71.

In the aforementioned embodiment, the slits 720 of the penetration part 72 are arranged at equal intervals around the imaginary line passing through the apex of the outer surface 710 of the rigid tip 71, but are not limited thereto. For example, the slits 720 of the penetration part 72 may be arranged at unequal intervals around the imaginary line passing through the apex of the outer surface 710 of the rigid tip 71.

In the aforementioned embodiment, the second end of the relay core 80 contacts the inner surface 711 (tapered surface) of the rigid tip 71, but is not limited thereto. For example, the second end of the relay core 80 may be located inside the rigid tip 71 without contacting (with keeping a distance away from) the inner surface 711 of the rigid tip 71. However, it is a matter of course that the second end of the relay core 80 is arranged at such a position that an ink guided by the relay core 80 is guided to the slits 720.

In the aforementioned embodiment, the inner surface 711 of the rigid tip 71 is a tapered surface having a shape dissimilar to the outer surface 710 of the rigid tip 71, but is not limited thereto. For example, the inner surface 711 of the rigid tip 71 may have a shape similar to the outer surface 710 of the rigid tip 71. Specifically, the outer surface 710 of the rigid tip 71 may be formed in a hemispherical shape recessed outward, while the outer surface 710 of the rigid tip 71 is formed in a hemispherical shape protruding outward. That is, the inner surface 711 of the rigid tip 71 may be formed in a hemispherical shape having a curvature radius smaller than that of the outer surface 710 of the rigid tip 71 to form the rigid tip 71 in a bowl shape or a dome shape. Further, it is a matter of course that the inner surface 711 of the rigid tip 71 may be a flat surface with the entire rigid tip 71 formed in a hemispherical shape. In this case, it is a matter of course that the penetration part 72 also penetrates from the outer surface 710 side to the inner surface 711 side of the rigid tip 71.

In the aforementioned embodiment, the cylindrical body 75 of the pen tip member 74 includes the large diameter cylindrical part 75*a* and the small diameter cylindrical part 75*b*, but is not limited thereto. For example, the cylindrical body 75 may be formed in a straight tube shape (i.e., cylindrical shape having the same diameter over the entire length).

In the aforementioned embodiment, the foam body 73 is substantially entirely filled in each of the slits 720 of the penetration part 72, but is not limited thereto. For example, the foam body 73 may be filled in the penetration part 72 (slits 720, or holes 721) at least on the side of the penetration part 72 close to the outer surface side of the rigid tip 71. That is, in the penetration part 72, the foam body 73 may be filled in an area which comes close to the application object at the time of applying the ink. Even with this configuration, the presence of the foam body 73 prevents shavings from entering the penetration part 72 or accumulating in the penetration part 72, so that an ink can be stably applied to the application object.

According to the present invention, it is possible to exhibit an excellent effect of being able to stably apply the ink to the application object while suppressing the abrasion of the ink application part.

A pen according to the present invention includes:

an ink reservoir configured to store an ink; and a pen tip section including an ink application part configured to apply the ink to an ink application object, the ink being supplied from the ink reservoir to the pen tip section, the ink application part of the pen tip section including:

a rigid tip made of a rigid material and having a hemispherical outer surface, an inner surface facing toward the ink reservoir, and a penetration part penetrating from the inner surface side to the outer surface side of the rigid tip; and at least one foam body filled in the penetration part at least on the side of the penetration part close to the outer surface of the rigid tip, and provided with at least one air bubble extending from an edge of the penetration part located on the outer surface side of the rigid tip to an edge of the penetration part located on the inner surface side of the rigid tip to provide communication therebetween.

According to the aforementioned configuration, since the rigid tip constituting the ink application part is made of a rigid material, abrasion due to the sliding of the rigid tip on the ink application object can be suppressed. Shavings may be generated from the ink application object as before due to the edge formed on the outer surface of the rigid tip for defining the penetration part that penetrates between the inner surface side and the outer surface side of the rigid tip.

However, according to the pen 1 with the aforementioned configuration, the foam body is filled in the penetration part at least on a side of the penetration part close to the outer surface of the rigid tip, and therefore the shavings of the ink application object are not allowed to enter (accumulate in) the penetration part. Since the foam body has air bubbles open to the outer surface, the air bubbles allow the ink application part (rigid tip) to communicate from the inside to the outside, that is, the air bubbles provide communication between the inside and the outside of the ink application part (rigid tip).

Accordingly, the ink is stably supplied to the outer surface of the rigid tip through the air bubbles of the foam body. Thereby, the ink can be stably applied to the ink application object by making the outer surface of the pen tip section (rigid tip) slide on (contact) the ink application object.

According to one form of the present invention, the penetration part may have slits passing through an apex of the outer surface of the rigid tip, and the slits may be arranged around the apex of the outer surface of the rigid tip in a radial manner.

According to the aforementioned configuration, the slits are arranged around the apex of the outer surface of the rigid tip in a radial manner, and thus arranged at positions around the apex of the outer surface of the rigid tip. Accordingly, the frequency at which the penetration part (foam body) of the rigid tip (ink application part) faces the ink application object increases. Thereby, the ink can be more stably applied to ink the application object even if the user uses the pen 1 in any inclination (posture).

In this case, the slits may have different widths from each other.

According to the above configuration where the slits have different widths from each other, an ink ejection amount, for example, an ink adhesion amount to the ink application object can be changed by rotating the pen around its axis to change the slit(s) facing the ink application object with the other one(s). That is, the thickness of line, the size of dots, or the like drawn on the ink application object can be changeable.

According to another form of the present invention, it is preferable that the at least one foam body be elastically deformable.

According to the aforementioned configuration where the foam body is elastically deformable, the foam body exposed from the penetration part is deformed when it contacts the ink application object. Thereby, it is possible to suppress the foam body from scratching the ink application object or damaging the ink application object.

A pen refill according to the present invention includes:

an ink reservoir configured to store an ink and be housed in a body shaft part that constitutes an outer shell of a pen; and a pen tip section including an ink application part exposed from the body shaft part and configured to apply the ink to an ink application object, the ink being supplied from the ink reservoir to the pen tip section, the ink application part of the pen tip section including:

a rigid tip made of a rigid material and having a hemispherical outer surface, an inner surface facing toward the ink reservoir, and a penetration part penetrating from the inner surface side to the outer surface side of the rigid tip; and at least one foam body filled in the penetration part at least on the side of the penetration part close to the outer surface of the rigid tip, and provided with at least one air bubble extending from an edge of the penetration part located on the outer surface side of the rigid tip to an edge of the penetration part located on the inner surface side of the rigid tip to provide communication therebetween.

According to the aforementioned configuration, since the rigid tip constituting the ink application part is made of a rigid material, abrasion due to the sliding of the rigid tip on the ink application object can be suppressed. Shavings may be generated from the ink application object as before due to the edge formed on the outer surface of the rigid tip for defining the penetration part that penetrates between the inner surface side and the outer surface side of the rigid tip.

However, according to the pen refill with the aforementioned configuration, the foam body is filled in the penetration part at least on the side of the penetration part close to the outer surface of the rigid tip, and therefore shavings of the ink application object are not allowed to enter (accumulate in) the penetration part. Since the foam body has air bubbles open to the outer surface, the air bubbles allow the ink application part (rigid tip) to communicate from the inside to the outside, that is, the air bubbles provide communication between the inside and the outside of the ink application part (rigid tip).

Accordingly, the ink is stably supplied to the outer surface of the rigid tip through the air bubbles of the foam body. Thereby, the ink can be stably applied to the ink application object by making the outer surface of the pen tip section (rigid tip) slide on (contact) the ink application object.

According to one form of the present invention, the penetration part may have slits passing through an apex of the outer surface of the rigid tip, and the slits may be arranged around the apex of the outer surface of the rigid tip in a radial manner.

According to the aforementioned configuration, the slits are arranged around the apex of the outer surface of the rigid tip in a radial manner, and thus arranged at positions around the apex of the outer surface of the rigid tip. Accordingly, the frequency at which the penetration part (foam body) of the rigid tip (ink application part) faces the ink application object increases. Thereby, the ink can be more stably applied to ink the application object even if the user uses the pen 1 in any inclination (posture).

In this case, the slits may have different widths from each other.

According to the aforementioned configuration where the slits have different widths from each other, an ink ejection amount, for example, an ink adhesion amount to the ink application object can be changed by rotating the pen around its axis to change the slit(s) facing the ink application object with the other one(s). That is, the thickness of line, the size of dots, or the like drawn on the ink application object can be changeable.

According to another form of the present invention, it is preferable that the at least one foam body be elastically deformable.

According to the aforementioned configuration where the foam body is elastically deformable, the foam body exposed from the penetration part is deformed when it contacts the ink application object. Thereby, it is possible to suppress the foam body from scratching the ink application object or damaging the ink application object.

REFERENCE SIGNS LIST

1: Pen
2: Pen body
3: Cap
4: Outer housing
5: Pen refill (refill)
6: Ink reservoir
7: Pen tip section
8: Ink guide part
9: Holder part
10: Connection part

40: Body shaft part
41: Tail
60: Peripheral wall
61: Closure part
70: Ink application part
71: Rigid tip
72: Penetration part
73: Foam body
74: Pen tip member
75: Cylindrical body
75*a*: Large diameter cylindrical part
75*b*: Small diameter cylindrical part
80: Relay core
81: Collector
90: Through hole
90*a*: First hole
90*b*: Second hole
710: Outer surface
711: Inner surface
720: Slit
721: Hole
751: First end
752: Second end
S: Internal space

The invention claimed is:

1. A pen comprising:

an ink reservoir configured to store an ink; and a pen tip section comprising an ink application part configured to apply the ink to an ink application object, the ink being supplied from the ink reservoir to the pen tip section, the ink application part of the pen tip section comprising:

a rigid tip made of a rigid material and having a hemispherical outer surface, an inner surface facing toward the ink reservoir, and a penetration part penetrating from the inner surface side to the outer surface side of the rigid tip;

at least one foam body filled in the penetration part at least on the side of the penetration part close to the outer surface of the rigid tip, and provided with at least one air bubble formed to communicate from the outer surface side of the foam body to the inner surface side of the foam body; and a relay core contacting the inner surface of the rigid tip and configured to allow the ink to be supplied to the foam body, wherein the penetration part has slits passing through an apex of the outer surface of the rigid tip, the slits are arranged around the apex of the outer surface of the rigid tip in a radial manner, and the slits have different widths from each other.

2. The pen according to claim 1, wherein the at least one foam body is elastically deformable.

3. A pen refill comprising:

an ink reservoir configured to store an ink and be housed in a body shaft part that constitutes an outer shell of a pen;

a pen tip section comprising an ink application part exposed from the body shaft part and configured to apply the ink to an ink application object, the ink being supplied from the ink reservoir to the pen tip section, the ink application part of the pen tip section comprising:

a rigid tip made of a rigid material and having a hemispherical outer surface, an inner surface facing toward the ink reservoir, and a penetration part penetrating from the inner surface side to the outer surface side of the rigid tip;

at least one foam body filled in the penetration part at least on the side of the penetration part close to the outer surface of the rigid tip, and provided with at least one air bubble formed to communicate from the outer surface side of the foam body to the inner surface side of the foam body; and a relay core contacting the inner surface of the rigid tip and configured to allow the ink to be supplied to the foam body, wherein the penetration part has slits passing through an apex of the outer surface of the rigid tip, the slits are arranged around the apex of the outer surface of the rigid tip in a radial manner, and the slits have different widths from each other.

4. The pen refill according to claim 3, wherein the at least one foam body is elastically deformable.

* * * * *